United States Patent [19]

Gandy

[11] 4,452,000

[45] Jun. 5, 1984

[54] ILLUMINATABLE SIGN

[75] Inventor: James Gandy, Mississauga, Canada

[73] Assignee: Signtech Inc., Mississauga, Canada

[21] Appl. No.: 279,179

[22] Filed: Jun. 30, 1981

[51] Int. Cl.[3] ..... G09F 13/04

[52] U.S. Cl. ..... 40/574; 40/156; 40/603

[58] Field of Search ..... 40/152.2, 564, 603, 40/156

[56] References Cited

U.S. PATENT DOCUMENTS

| | | | |
|---|---|---|---|
| 1,475,977 | 12/1923 | West | 40/564 |
| 1,597,770 | 8/1926 | Cruver | 40/564 |
| 1,773,972 | 8/1930 | Eberhart | 40/156 |
| 2,637,132 | 5/1953 | Helms et al. | 40/152.2 |
| 4,041,861 | 8/1977 | Alter | 40/603 |
| 4,194,312 | 3/1980 | Connors et al. | 40/156 |
| 4,317,302 | 3/1982 | Von De Linde | 40/564 |

*Primary Examiner*—Gene Mancene
*Assistant Examiner*—Wenceslao J. Contreras
*Attorney, Agent, or Firm*—Robert F. Delbridge; Arne I. Fors

[57] ABSTRACT

An illuminatable sign has a housing having an open front and containing a light source. A closure extending over the open front comprises a frame extending around an opening, a sheet of flexible light-transmitting material extending across and covering said opening; and bolts for securing a peripheral marginal portion of the sheet by adjustably tensioning the sheet across the opening.

6 Claims, 7 Drawing Figures

ILLUMINATABLE SIGN

FIELD OF THE INVENTION

The present invention relates to illuminated signs.

BACKGROUND OF THE INVENTION

One type of illuminated sign which is in use at the present time has a housing provided with an open front or an open front and an open rear and containing within the housing a florescent light fitting. The open front of the housing is provided with a cover in the form of a frame, which is pivotally connected along the top of the frame to the top of the housing, and a screen of rigid sheet material covering an opening defined by the frame, the periphery of the sheet material being secured to the frame. The frame is made of extruded metal sections which are connected together, at the corners of the frame, by L-shaped connectors engaging in the extruded metal sections. The rigid sheet material of the screen is light-transmitting and has either opaque insignia thereon or an opaque zone surrounding light-transmitting insignia. In the case of the housing having open rear, a similiar frame and screen are provided at the rear of the housing. Such screens are normally made of glass.

An illuminated sign of this type is disclosed in my co-pending U.S. patent application Ser. No. 050,362 filed June 20, 1979, the disclosure of which is incorporated herein by reference.

The use of glass for the screens of such signs is expensive and, moreover, glass sign screens are fragile and can easily be broken by accident or by vandals.

OBJECTS OF THE INVENTION

It is an object of the present invention to provide a novel and improved illuminated sign.

It is a further object of the present invention to provide an illuminated sign having a screen made of flexible, light-transmitting sheet material. It is a still further object of the present invention to provide an illuminated sign having a screen which is less expensive and less readily breakable than prior art sign screens.

It is a still further object of the present invention to provide an illuminated sign having a screen made of flexible material secured to a frame with means for preventing wrinkling of the flexible material and for tightening the flexible material.

SUMMARY OF THE INVENTION

According to the invention, there is provided an illuminatable sign having an open-fronted housing containing a light source and a closure extending over the open front of the housing, the closure comprising a frame extending around an opening and a sheet of flexible light-transmitting material extending across and covering the opening. Means are provided for securing a peripheral marginal portion of the sheet to the frame and, according to one feature of the invention, such means are adjustable for releasably retaining the marginal portion of the sheet relative to the frame.

According to another feature of the invention, a sheet support is provided for supporting the rear side of the sheet around the opening, the support means projecting forwardly of the securing means and the securing means being adjustable for tightening the sheet across the support means. The support means presents a straight edge across which the sheet is pulled to prevent the formation of wrinkles in the sheet.

BRIEF DESCRIPTION OF THE DRAWINGS

The invention will be more readily understood from the following description of embodiments thereof given, by way of example, with reference to the accompanying drawings, in which.

Figure 1:
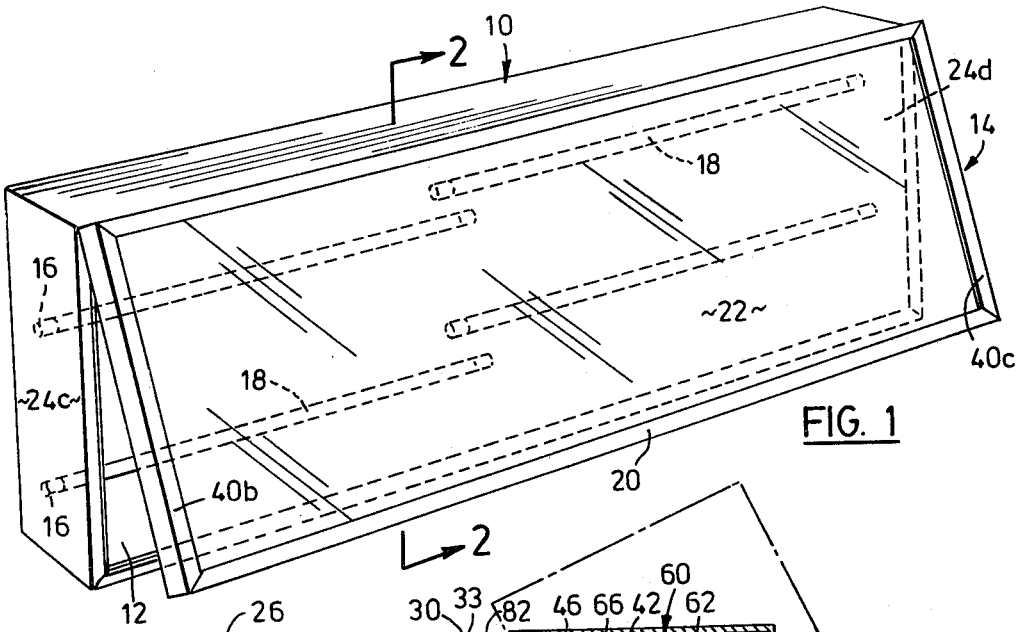
FIG. 1 shows a view in perspective of an illuminated sign according to the preferred embodiment and best mode of the present invention having a front cover in a partially opened position.

The sign shown in FIG. 1 has a housing, which is indicated generally by reference numeral 10 and has an open front 12, and a front cover, which is indicated generally by reference numeral 14 and which is peripherally connected along its top to the housing 10, as described in greater detail below.

The housing 10 contains holders 16 for florescent light tubes 18, and the front cover 14 comprises a frame 20 defining an opening and a screen in the form of a sheet 22 of flexible, light-transmitting material extending across and covering the opening formed by the frame 20.

Figure 2:
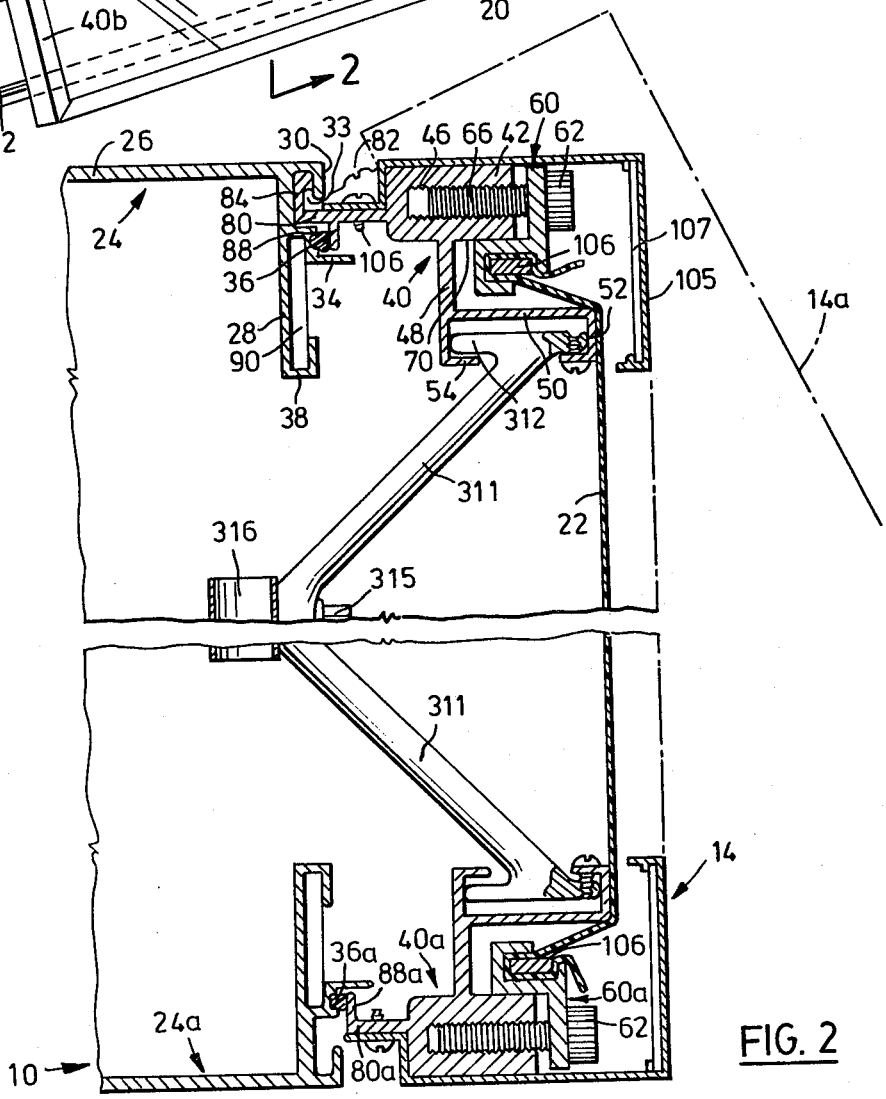
FIG. 2 shows a view taken in cross-section along the line 2—2 of FIG. 1 with the cover shown in its closed condition.

Referring now to FIG. 2, the housing 10 has a top 24 and a bottom **24*a***, which are formed of similiar metal extrusions. However, it is at this point mentioned that the present invention is not restricted to housings made of extrusions but, on the contrary, it is readily applicable to illuminated sign housings made of sheet metal.

The housing top 24, as viewed in FIG. 2, comprises a main horizontal web 26 and a vertical web 28 extending downwardly, and thus inwardly of the housing, from the web 26, the web 28 being spaced rearwardly, i.e. to the left as viewed in FIG. 2, from the front of the web 26, at which a shallow vertical web 30 projects inwardly of the housing so as to define a recess 32 between the webs 28 and 30, the recess 32 facing inwardly of the housing.

The web 28 is also formed with a forwardly extending ledge projection 34 along the length thereof, an elongate elastomeric seal member 36 being partially recessed in the ledge projection 34.

The innermost portion of the web 28 terminates in an inner edge 38 of U-shaped cross-section.

The frame 20 comprises, as viewed in FIG. 2, upper and lower frame members indicated generally by reference numerals 40 and **40*a*, respectively, which are connected at opposite ends thereof by side frame members 40*b* and 40*c* (FIG. 1**).

The upper frame number 40 comprises an elongate body portion 42, an elongate, forwardly-open slot 44 being formed in the body portion 42 along the length thereof and the opposed side walls of the slot 44 being formed with longitudinal ribs 46.

A web 48 depends from the body portion 42 and a horizontal web 50 projects forwardly from the web 48 and terminates in an end portion 52 of U-shaped cross-section which, together with an end portion 54 of L-shaped cross-section at the inner end of the web 48, defines a partially downwardly or inwardly open recess 56 of rectangular cross-section.

The end portion 52 presents a flat vertical front face 58 which is directed towards the front of the sign.

Upper and lower elongate screen retainer members indicated generally by reference numerals 60 and **60*a* are secured to the upper and lower frame members 40 by bolts 62**.

The upper screen retainer member 60 comprises vertical web 64, which is adjustably secured by the uppermost bolts 62, to the body portion 42 of the upper frame member 40, the bolts 62 having threaded shanks 66 screwed into engagement with the ribs 46 of the slot 44. As will be readily apparent, further tigtening of the bolts 62 will serve to displace the upper screen members 60 in a rearward direction to adjustably tighten the screen 22 across the opening defined by the faces 58.

The upper screen retainer member 60 also has a rearwardly extending horizontal web 68 which bears in sliding engagement with the flat underside 70 of the body portion 42 of the upper frame member 40, a vertical rear web 71 depending from the rear of the web 68 and a horizontally and forwardly extending web 72 projecting from the bottom or innermost portion of the web 71. A web extension 74 depends vertically from the web 64 at the front side of the upper screen retainer member 60.

The webs 68, 71 and 72 and the web extension 74 define an elongate recess 76 extending the length of the upper screen member 60, the web 72 and the web extension 74 being so dimensioned as to define therebetween a gap 78, so that the recess 76 is partially open at a side thereof facing inwardly of an opening defined by the frame 14.

As can be seen from FIG. 2, the housing top 24 and bottom **24*a*, the upper and lower frame members 40 and 40*a* and the upper and lower screen retainer members 60 and 60*a*, which are all metal extrusions, have, respectively, the same shapes, and therefore it not necessary to describe the lower housing portion 24*a*, the lower frame member 40*a* and the lower screen retainer member 60*a*** in greater detail herein.

However, the rearmost portion of the upper frame member 40 differs from that of the lower frame member **40*a***.

More particularly, referring finally to the upper frame member 40, a horizontal flange 80 extends rearwardly from the body portion 42 and is spaced downwardly from the top of the body portion 42 to define an upwardly open recess 82 in conjunction with a vertical web 84 upstanding from the rear of the web 80. The upper edge of the web 84 is formed with a rounded portion 86 which is received within the recess 32 and serves as a pivot to allow pivotation of the cover 14 from the closed position, in which it is shown in full lines in FIGS. 1 and 2, to the partially open position, indicated by a dot - dash line **14*a* in FIG. 2, and beyond. However, it is at this point emphasized that the present invention is not limited to this type of pivotal connection between the upper frame member 40 and the housing top 24**.

A web 88 depending from the underside of the horizontal flange 80 abuts the elastomeric seal member 36, when the front cover 14 is in its closed position as shown in FIG. 2, to provide a seal between the front cover 14 and the housing 10.

Referring now to the lower frame member **40*a*, it will be seen that a rearwardly extending horizontal flange 80*a* is provided which is shorter than the flange 80 and which terminates at an upstanding web 88*a* co-operating with an elastomeric seal member 36*a* corresponding to the elastomeric seal member 36**.

The side frame members **40*b* and 40*c* are similiar to the lower frame member 40*a***.

Figure 5:
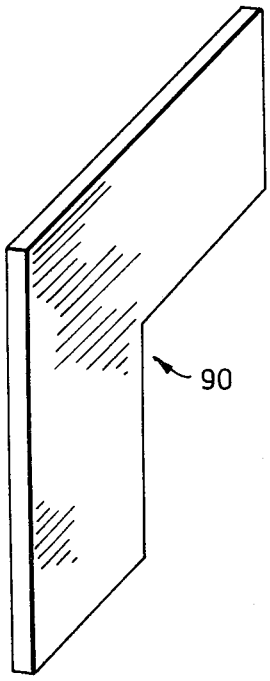
FIG. 5 shows a view in perspective of a corner bracket for connecting together parts of the sign of FIG. 1.

The housing top and bottom 24, **24*a* are connected to housing sides 24*c*, 24*d*, which are extrusions having same cross-sectional shape as the housing top and bottom 24, 24*a*, by L-shaped corner brackets, one of which is shown in FIG. 5 and illustrated by reference numeral 90. These corner brackets are of known construction and are therefore not described in detail herein. Such brackets are inserted into the U-shaped inner edge 38 and between the web 28 and the ledge projection 34 of the housing top 24, and the corresponding parts of the lower and side frame members 24*a*, 24*c* and 24*d***, to secure these frame members together.

Figure 4:
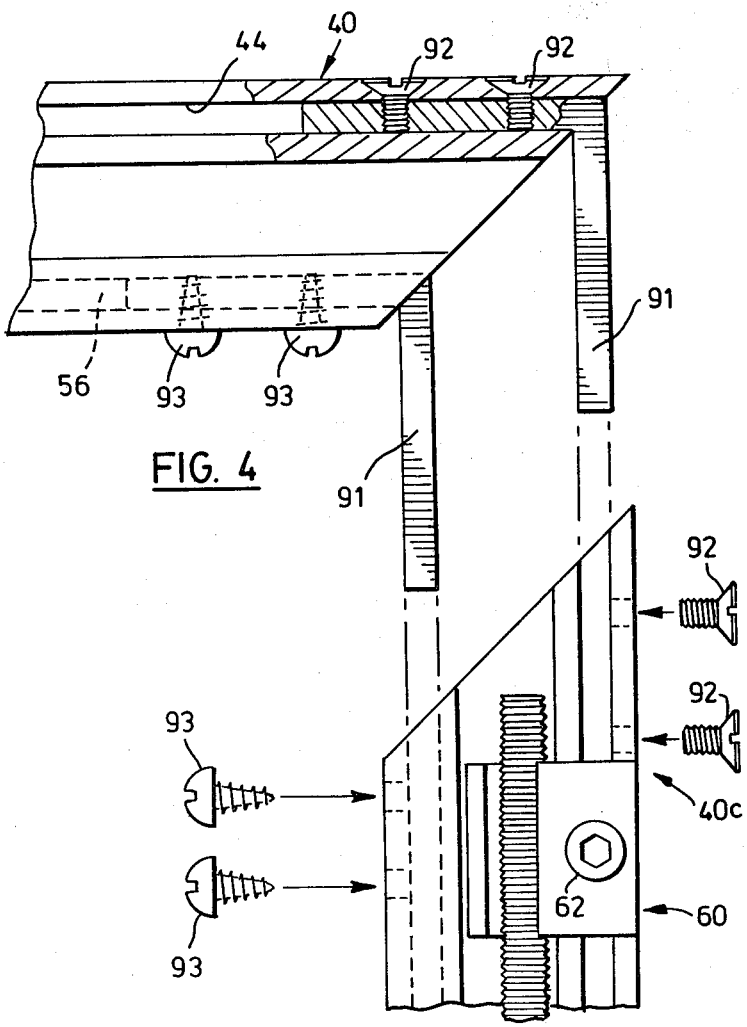
FIG. 4 shows a broken-away view in front elevation of parts of one corner of the sign of FIG. 1 with the parts separated as during assembly of the sign.

FIG. 4 illustrates the connection of the upper frame member 40 and the side frame member **40*c*** at one of the corners of the frame, the frame members being suitably connected at the other corners of the frame.

As shown in FIG. 4, a pair of L-shaped brackets 91 are engaged in the upper frame member 40, and more particularly are secured in the recess 56 and the slot 44 (FIG. 3) by screws 92 and 93 and are about to be inserted into the corresponding recess and slot in the side frame member **40*c* and secured therein by further screws 92 and 93**.

Figure 6:
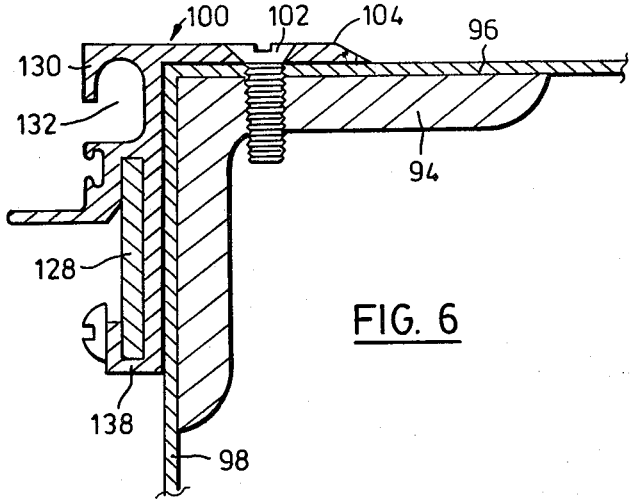
FIG. 6 shows a view taken in cross-section through part of the housing of an illuminated sign according to a second embodiment of the invention.

As mentioned previously, it is not essential that the housing 10 be formed from extrusions such as those described above, and an embodiment of the invention for use with a housing made of sheet metal is illustrated in FIG. 6.

As shown in FIG. 6, an angle member 94 is provided in a top corner of a housing, which is not shown in detail, between a sheet metal top 96 and a sheet metal front 98 of the housing, and a front cover support member indicated generally by reference numeral 100 is secured to the top and front outer surfaces of the housing corner by means of a screw 102 extending through the support member 100 into threaded engagement with the angle member 94.

The support member 100 has a top, horizontal web 104, which is seated on the top surface of the housing and through which the screw 102 extends. The horizontal web 104 corresponds to the main horizontal web 26 of the housing top 24 illustrated in FIG. 2 and, from comparison of FIGS. 2 and 6, it can be seen that the remaining parts of the support member 100, which have been indicated by reference numerals corresponding to those employed in FIG. 2 but increased by 100, are similar to the above-described parts of the front portion of the housing top 24 and are not described in detail herein. As will be readily apparent, the vertical web 84 and the rounded portion 86 of the upper frame member 40 can be pivotally engaged in the recess 32 of the support member 100 for pivotally connecting the front cover 14 to the support member 100.

Figure 3:
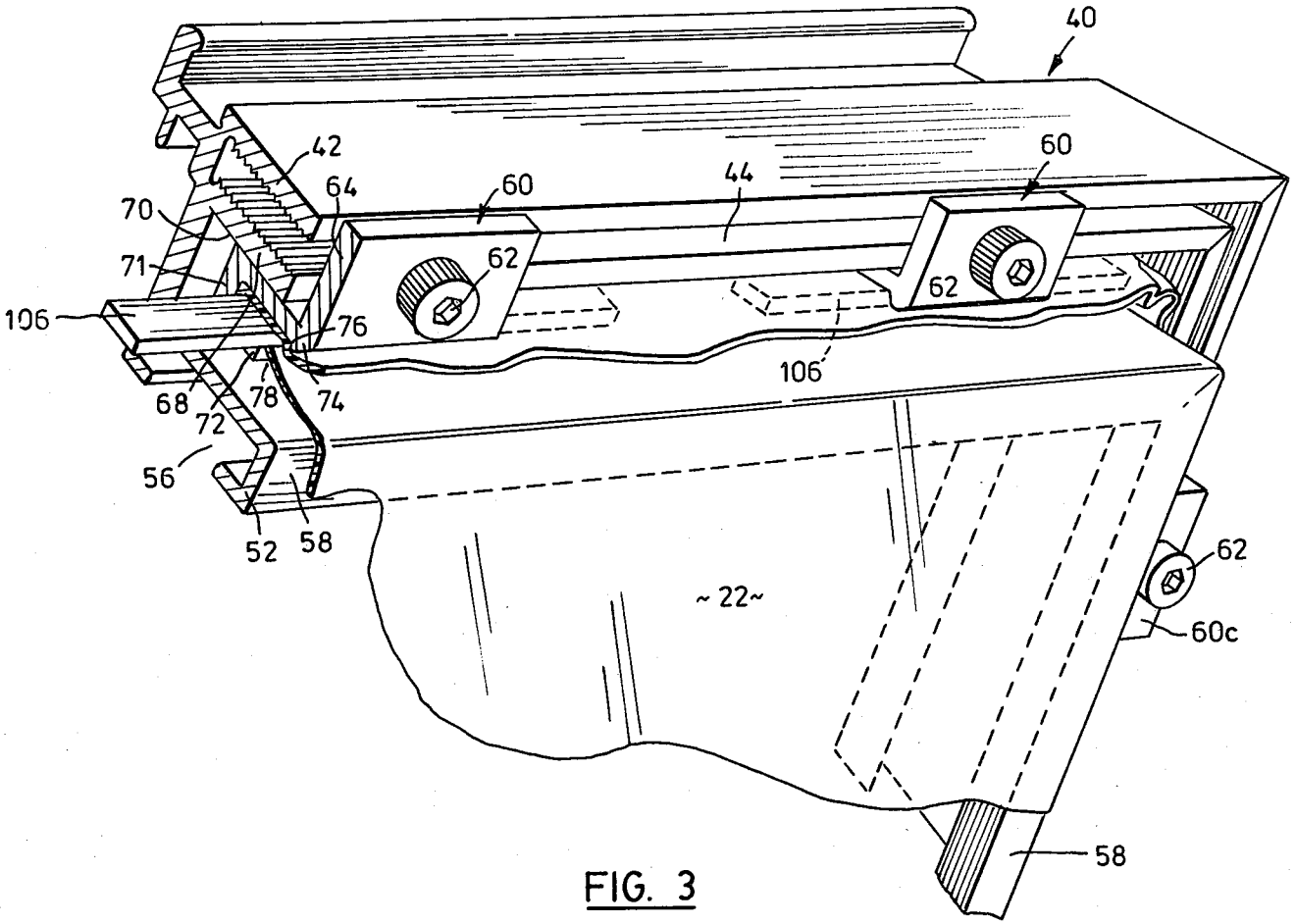
FIG. 3 shows a broken-away view in perspective of parts of the sign of FIG. 1.

As shown in FIGS. 2 and 3, the flexible light-transmitting material sheet 22 has marginal edge portions which are wrapped around retainer bars 106 within the recess 76 in the upper screen retainer member 60 and corresponding recesses in the lower screen retainer member 60*a* and corresponding retainer members which are secured to the side frame members 40*b* and 40*c* and one of which is indicated by reference numeral 60*c* in FIG. 3. These retainer bars are formed as extrusions of rectangular cross-section and serve to secure the marginal portions of the sheet 22.

During assembly of the front cover 14, the marginal portions of the sheet 22 are wrapped around the retainer bars such as the retainer bar 106 and the latter are then inserted into the recesses in the retainer members through the gap 78 of the upper retainer member 60 and the corresponding gaps in other retainer members. In this way, the sheet 22 is stretched over the opening defined by the web end portion 52 of the upper frame member 40 and the corresponding end portions of the other frame members. The flat vertical front face 58 of the upper frame member 40 and the corresponding flat vertical faces of the other frame members, over which the sheet 22 is stretched, prevent the formation of wrinkles in the sheet 22, particularly when the bolts 62 are tightened in order to tighten the sheet 22 across these flat front faces. As will be readily apparent, the provision of the slots 44 for receiving the bolts 62 enables the bolts 62 to be positioned anywhere around the frame without any need to drill holes into the frame for receiving the bolts 62. The sheet 22 can therefore be retained anywhere around the frame without drilling and, moreover, can be tightened at any position around the frame, so that it is a simple matter to secure the flexible screen 22 in a flat, wrinkle-free condition over the opening defined by the frame.

When the screen 22 has been installed and adjusted, cover members 105 connected at the corners of the frame by L-shaped bracket 107 members by screws 106. The cover members 105 extend in front of the frame members and thus conceal the frame members, the marginal portions of the sheet 22 and the bolts 62 and other above-described components employed for securing the sheet 22.

Figure 7:
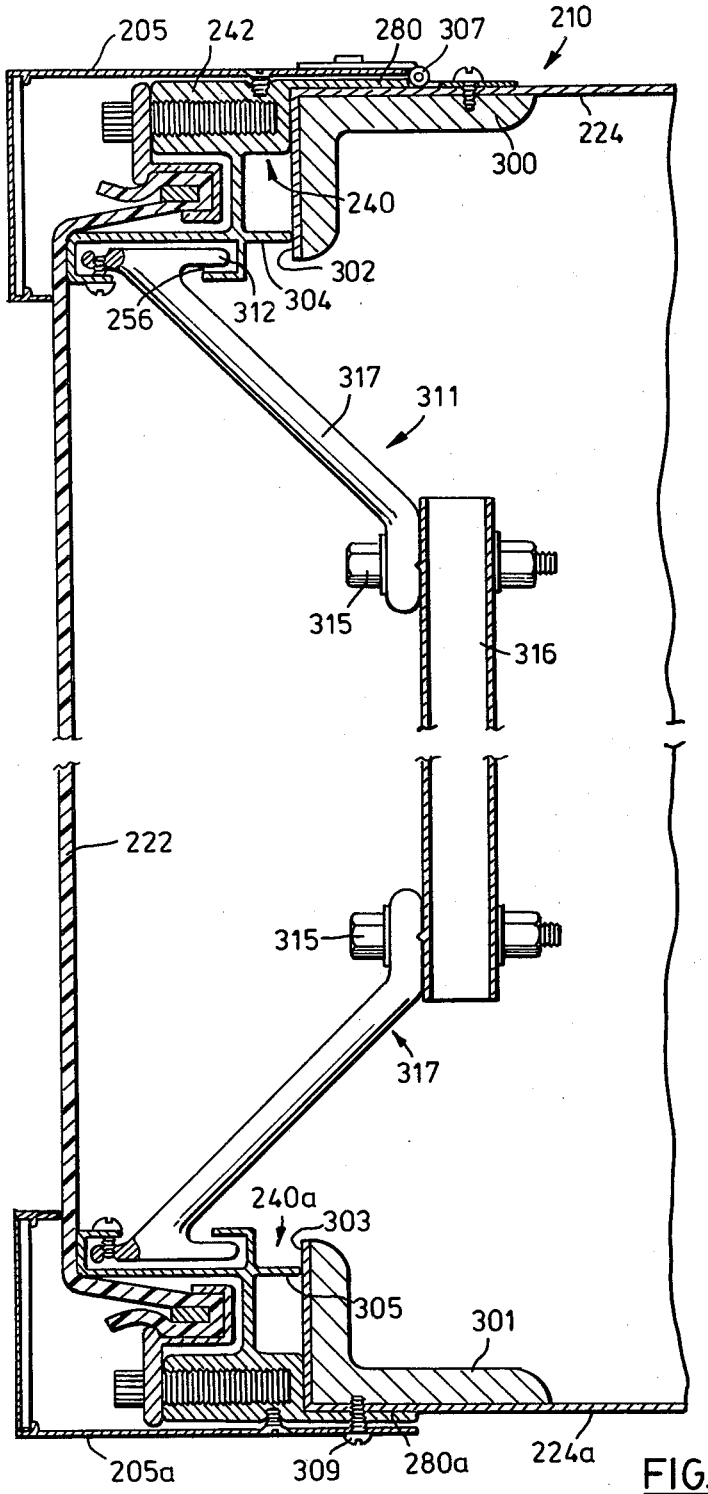
FIG. 7 is a cross-sectional view similar to FIG. 2 and showing a further embodiment.

FIG. 7 shows a further embodiment of the invention for use with a housing made of sheet metal and in this figure parts which correspond to those of FIG. 2 have been indicated by corresponding reference numerals in the 200 series.

In this embodiment, the housing, indicated generally by reference numeral 210, has a top 224 and a bottom 224*a* of sheet metal, which are secured to respective angle members 300 and 301, and sheet metal facings 302 and 303 entending in front of the angle members 300 and 301.

Upper and lower frame members 240 and 240*a* have webs 280 and 280*a* seated on the housing top and bottom 224 and 224*a*, respectively, and webs 304 and 305, projecting rearwardly of the webs 248, in abutment with the sheet metal facings 302 and 303. The webs 280 and 280*a* differ from the webs 80 and 80*a* of FIG. 2 by being displaced outwardly to the periphery of the frame formed by the frame members 240 and 240*a* and by the side frame members, which are not shown. Otherwise, the frame members of FIG. 7 are similar to those of FIG. 2.

Cover members 205 and 205*a* are secured by screws 306 to the upper and lower frame members 240 and 240*a* and the upper frame member 240 is pivotally secured to the housing top 224 by a hinge 307, while the lower frame member 240*a* is releaseably secured to the housing bottom 224*a* by screws, one of which is shown and indicated by reference numeral 309. By removal of these screws securing the lower frame member 240*a* to the housing bottom 224*a*, screen 222 and its frame, together with the cover members, can be pivoted upwardly about the axis of the hinge 307 to provide access to the interior of the housing, e.g. for maintenance purposes.

Frame support members indicated generally by reference numerals 311 are engaged with the upper and lower frame members 240 and 240*a* to brace and to resist pulling together of the latter as bolts 262 are tightened to tension and lighten the screw 222.

The frame support members 311 are formed at their outer ends with flanges 312, which are secured within longitudinal recesses 256 in the frame members, and are secured at their opposite ends by bolts 315 to opposite ends of a vertical length of tubing 316, the frame support members 311 having bar-shaped intermediate portions 312 inclined inwardly and rearwardly from the frame, i.e. away from the screen 222. Corresponding horizontal frame support members and tubing may if required be provided between the side frame members and the horizontal and vertical tubing may, e.g. be welded together at points of intersection thereof.

The frame support members 311 and tubing 316 are also provided in the embodiment of the invention illustrated in FIG. 2.

In all of the above-described embodiments of the invention, the screen is made of polyester reinforced vinyl film and is preferably translucent white, graphics (not shown) being provided on the screen as desired by spraying, silk screening or heat transfer process, and the extrusions are aluminium.

I claim:

1. A sign comprising a rigid peripheral frame extending around an opening lying in a plane, a sheet of flexible sign material extending across the opening, said frame having an edge surrounding the opening, the flexible sign sheet having a peripheral edge portion extending rearwardly from the plane of the opening at the frame edge, and a series of separate sheet tensioning devices spaced around the frame rearwardly of the plane of the opening for tensioning the flexible sign sheet across the opening, each tensioning device comprising means for retaining the peripheral edge portion of the flexible sign sheet and an adjustable bolt having a head and threaded shank extending therefrom, said head abutting the retaining means and said shank extending through an aperture in the retaining means in a direction extending rearwardly of the plane of the opening into threaded engagement with the frame to enable the bolt head to be rotated to screw the shank into further threaded engagement with the frame with consequent rearward movement of the retaining means independently of the retaining means of the other sheet tensioning devices, while the retaining means is holding the edge portion of the flexible sign sheet, to cause the peripheral edge portion of the flexible sign sheet to be pulled rearwardly across the front edge, thereby tensioning the flexible sign sheet across the opening.

2. A sign according to claim 1 wherein the adjustable bolt of each sheet tensioning device extends in a rearwardly direction which is substantially perpendicular to the plane of the opening.

3. A sign according to claim 1 wherein the retaining means of each sheet tensioning device comprises a retainer member having said aperture and a recess, and a retainer bar retained in the recess, the peripheral edge portion of the flexible sign sheet being wrapped around the retainer bar and thereby retained by the retaining means, the retaining member and retaining bar of each retaining means being separate from the retainer members and retainer bars of the other retaining means.

4. A sign according to claim 1 wherein the frame has an elongated recess with opposed parallel side walls having ribs extending therealong, said ribs receiving the shank of an adjustable bolt of a sheet tensioning device in threaded engagement therewith at a preselected position along the length of the recess.

5. A sign according to claim 1 wherein the frame has opposed sides and at least one bracing means extending between said sides intermediate their ends and behind the flexible sign sheet rearwardly of the plane of the opening to brace the frame against tension in the flexible sign sheet.

6. A sign according to claim 5 wherein the bracing means comprises first and second bracing members extending from respective opposite sides of the frame in a direction inclined rearwardly from the plane of the opening, and a third bracing member extending in parallel spaced relationship to the flexible sign sheet and secured to the first and second bracing members.

* * * * *